US006111162A

United States Patent [19]

Rossini et al.

[11] Patent Number: 6,111,162

[45] Date of Patent: Aug. 29, 2000

[54] PROCESS FOR REMOVING OXYGENATED CONTAMINANTS FROM HYDROCARBON STREAMS

[75] Inventors: Stefano Rossini, Milan; Valerio Piccoli, Monza, both of Italy

[73] Assignee: Snamprogetti S.p.A., San Donato, Italy

[21] Appl. No.: 09/147,164

[22] PCT Filed: Apr. 16, 1997

[86] PCT No.: PCT/EP97/01994

§ 371 Date: Oct. 21, 1998

§ 102(e) Date: Oct. 21, 1998

[87] PCT Pub. No.: WO97/40121

PCT Pub. Date: Oct. 30, 1997

[30] Foreign Application Priority Data

Apr. 22, 1996 [IT] Italy ..... MI96A0773

[51] Int. Cl.[7] ..... C07C 7/12; C10G 25/05; C10G 25/12; C10G 25/00

[52] U.S. Cl. ..... 585/824; 585/820; 585/823; 585/826; 208/263; 208/299; 208/305; 208/307

[58] Field of Search ..... 208/263, 299, 208/307, 305; 585/820, 823, 824, 826

[56] References Cited

U.S. PATENT DOCUMENTS

| | | | |
|---|---|---|---|
| 2,653,959 | 9/1953 | Moore et al. | 260/450 |
| 2,719,206 | 9/1955 | Gilmore | 210/42.5 |
| 4,404,118 | 9/1983 | Herskovits | 252/411 R |
| 5,245,107 | 9/1993 | Yon et al. | 585/824 |
| 5,466,364 | 11/1995 | Kaul et al. | 208/307 |

FOREIGN PATENT DOCUMENTS 693967 7/1953 United Kingdom .

*Primary Examiner*—Walter D. Griffin
*Assistant Examiner*—Tam M. Nguyen
*Attorney, Agent, or Firm*—Oblon, Spivak, McClelland, Maier & Neustadt, P.C.

[57] ABSTRACT

Process for selectively removing oxygenated contaminants from streams prevalently containing hydrocarbons with from 3 to 8 carbon atoms characterized in that it comprises an adsorption step wherein said contaminants are adsorbed by an adsorbent essentially consisting of silica gel at a temperature of between 0 and 150° C. and a pressure of between 1 and 20 atms and a regeneration step for removing the adsorbed substances by thermal treatment in a stream of insert gas carried out at a temperature of between 100 and 200° C.

4 Claims, No Drawings

PROCESS FOR REMOVING OXYGENATED CONTAMINANTS FROM HYDROCARBON STREAMS

The present invention relates to a process for selectively removing oxygenated contaminants from hydrocarbon streams.

The presence of oxygenated impurities in these streams is generally extremely harmful, even at a level of tens part per million, especially when these streams must be sent to other reaction steps.

Olefinic cuts with four and five carbon atoms are very often subjected to these problems. In fact, for example, it is well known that iso-olefins react with R—OH alcohols (preferably methanol) to give the corresponding methyl teralkyl ethers (MTBE, TAME). After separation of the oxygenated products, the exhausted streams without iso-olefins (Refined products) can be sent to alkylation, if the oxygenated products are present in quantities of less than 10 ppm, to avoid abnormal consumption of the catalyst. The oxygenated products present in these cases are the corresponding ter-alkyl alcohols, obtained by the acid-catalyzed addition of water to the iso-olefin and alkyl-teralkyl ethers, generally deriving from impurities in the charge—for example MTBE in $C_5$ cuts as it is extremely costly to obtain a $C_5$ olefin stream without isobutene and also the boiling point of MTBE is very close to that of $C_5$ hydrocarbons.

Another case in which oxygenated products are harmful is in the polymerization of iso-olefins, preferably isobutene with a high purity obtained by the decomposition of the corresponding alkylether, i.e. MTBE. Also in this case the total oxygenated products (methanol, dimethylether, water) must be less than 10 ppm.

Oxygenated products, on the level of impurities, are generally harmful in processes using zeolites owing to their great affinity. Competitive adsorptions can in fact arise which reduce the overall efficiency of the process.

The art discloses various methods for removing these oxygenated products. In particular EP-504980 can be mentioned wherein the teralkyl-alkyl ethers and corresponding alcohols (MTBE, TAME, TBA, TAA) are removed from $C_5$ streams in the synthesis of TAME by catalytic cracking on suitable material based on silica with small quantities cc alumina, at temperatures of between 200 and 250° C. In this case iso-olefins are obtained and the corresponding oxygenated product, methanol or water, which must then in turn be removed. It is evident that this system can only be applied when there is the possibility of the selective breaking of a C—O bond to give well-defined chemical species. Dimethylether and methanol for example do not belong to this group.

A process has been surprisingly found using a material which combines a high adsorbing capacity (molecules retained per unit of the adsorbent mass under conditions of equilibrium) for oxygenated compounds and a high adsorption rate of these molecules (molecules adsorbed per unit of time), also allowing said material to be easily and completely regenerated. This latter aspect, although not indicated in the art cited above, is of fundamental importance in applying the method on an industrial scale.

The process for selectively removing oxygenated contaminants from streams prevalently containing hydrocarbons with from 3 to 8 carbon atoms, of the present invention, is characterized in that it comprises an adsorption step wherein said oxygenated compounds are adsorbed with an adsorbent essentially consisting of silica gel, carried out at a temperature of between 0 and 150° C. and a pressure of between 1 and 20 atms, and a regeneration step for removing the substances adsorbed by means of thermal treatment in a stream of inert gas, carried out at a temperature of between 100 and 200° C., with the proviso that the oxygenated contaminant is not water.

The inert gas used in the thermal treatment can be selected from gases normally used for carrying out regenerations, such as nitrogen, helium, steam, flue gas, air, etc.

The silica gel used can have a surface area preferably higher than 300 $m^2/g$, more preferably higher than 400 $m^2/g$, and a porous volume preferably of between 0.38 and 1.75 ml/g.

The oxygenated compounds which can be present in the hydrocarbon streams, are preferably $C_1$–$C_{10}$ alcohols, alkylethers, symmetrical and mixed, but also occasionally aldehydes and ketones.

The hydrocarbon streams under consideration can typically contain paraffins, olefins or diolefins, prevalently with from 3 to 8 carbon atoms and do not normally contain more than 10000 ppm of oxygenated compounds. This however does not prevent the process claimed herein to be also used for streams with a much higher content of oxygenated compounds: it will be necessary to suitably dimension the adsorption section.

For example commercial silica gel may contain some impurities, such as for example $Na^+$, $Ca^{2+}$, $Fe^{3+}$, $SO_4^{2-}$ and $Cl^-$, at a level of a few hundreds of ppm, or modifiers for specific uses, such as for example $Co^{2+}$, or be in the form of a cogel and contain for example $Al^{3+}$, $Zr^{4+}$, $Ti^{4+}$, $Mg^{2+}$.

A very interesting aspect of this material is that it has a moderate acidity under the applicative conditions, which however is not sufficient to cause undesired polymerization or isomerization reactions in the hydrocarbon streams, mainly based on olefins which are to be treated and not sufficient to react with the oxygenated compound, which would make it difficult to regenerate.

Another peculiar and surprising aspect of this material is that, if a stream is to be treated which contemporaneously contains paraffins and olefins, it does not preferentially adsorb the olefinic component and does not therefore alter the composition of the hydrocarbon stream which is being used.

A further aspect which is equally important as those already mentioned consists in the capacity of silica gel to selectively adsorb oxygenated compounds from hydrocarbon streams both in gaseous and liquid phases.

The removal of oxygenated compounds is generally a cyclic operation which involves an adsorption step and a regeneration step of the material (desorption of the oxygenated compound adsorbed). The times for each step of the cycle are strictly correlated to the operating conditions in adsorption phase, such as for example the quantity of oxygenated compound to be removed, the space velocity, the operating pressure and temperature. It can be easily deduced that by increasing the content of the oxygenated compound and the space velocity, the times of the adsorption phase are shortened, as the saturation of the material is more rapidly reached, or by increasing the temperature the adsorbing capacity decreases.

Silica gel has an adsorption capacity for oxygenated compounds which can even reach 14–15% by weight, if they are in contact with a hydrocarbon stream which contains several thousand ppm.

The following examples, which do not limit the scope of the invention, illustrate the applicative methods of silica gel ir, the removal of oxygenated compounds.

EXAMPLES

The tests are carried out on stream in a tubular reactor charging a certain quantity of adsorbing material, feeding a suitable hydrocarbon stream, containing paraffins and olefins and oxygenated compounds with a preset space velocity in terms of WHSV (Weight Hourly Space Velocity) in reciprocal hours. The effluent is analyzed by gaschromatography by continuously taking samples; the test is interrupted and the material considered saturated when the contaminants begin to appear in the outgoing stream. The adsorbing capacity percentage is calculated as:

Adsorbing capacity percentage==weight of oxygenated products withheld/weight of catalyst×100.

The regenerability of the materials was verified by subjecting the exhausted material to thermal treatment in a stream of inert gas (air, nitrogen, flue gas, steam, etc.).

In short it was asserted that silica gel has the capacity of selectively adsorbing oxygenated contaminants from hydrocarbon streams in both liquid and gas phase. It is also mechanically and chemically stable under operating conditions and can be easily regenerated without reducing its efficiency after repeated adsorption-regeneration cycles.

Example 1

A stream is fed at a pressure of 2.3 atm and WHSV of 6 $h^{-1}$ to the reactor containing 0.5 g of silica gel at room temperature (20° C.), having the following composition:

| Compound | Weight |
|---|---|
| 2-methyl-butane | 97.63% |
| 1-pentene | 2.15% |
| methyl-teramylic ether (TAME) | 125 ppm |
| teramylic alcohol (TAA) | 2112 ppm |

After a run of 10.5 hours the oxygenated products appear in the outgoing stream in an amount of 73 ppm of TAME. The adsorbing capacity is 14%.

Example 2

A stream is fed in the experimental configuration of example 1 at room temperature (20° C.), a pressure of 2.3 atm and WHSV of 10 $h^{-1}$, having the following composition:

| Compound | Weight |
|---|---|
| 2-methyl-butane | 97.50% |
| 1-pentene | 2.17% |
| methyl-terbutylic ether (MTBE) | 1287 ppm |
| methyl-teramylic ether (TAME) | 193 ppm |
| teramylic alcohol (TAA) | 1873 ppm |

After a run of 3.9 hours the oxygenated products appear in the outgoing stream in an amount of 10 ppm of TAME and 15 ppm of MTBE.
The adsorbing capacity is 12.5%.

Example 3

A stream is fed in the experimental configuration of example 1 at room temperature (20° C.), a pressure of 2.3 atm and WHSV of 10 $h^{-1}$, having the following composition:

| Compound | Weight |
|---|---|
| 2-methyl-butane | 97.34% |
| 1-pentene | 2.35% |
| terbutylic alcohol (TBA) | 3108 ppm |

After a run of 4 hours the TBA appears in the outgoing stream in an amount of 63 ppm.
The adsorbing capacity is 12.4%.

Example 4

A stream is fed in the experimental configuration of example 1 at room temperature (20° C.), a pressure of 2.3 atm and WHSV of 10 $h^{-1}$, having the following composition:

| Compound | Weight |
|---|---|
| 2-methyl-butane | 97.63% |
| 1-pentene | 2.08% |
| methyl alcohol | 2875 ppm |

After a run of 4 hours the methanol appears in the outgoing stream in an amount of 93 ppm.
The adsorbing capacity is 11.6%.

Example 5

A stream is fed in the experimental configuration of example 1 at room temperature (20° C.), a pressure of 2.3 atm and WHSV of 10 $h^{-1}$, having the following composition:

| Compound | Weight |
|---|---|
| 2-methyl-butane | 97.84% |
| 1-pentene | 1.97% |
| dimethyl ether (DME) | 1883 ppm |

After a run of 4.5 hours the DME appears in the outgoing stream in an amount of 58 ppm.
The adsorbing capacity is 8.5%.

Example 6

A stream is fed in the experimental configuration of example 1 at a temperature of 84° C., a pressure of 6.5 atm and WHSV of 10 $h^{-1}$, having the following composition:

| Compound | Weight |
|---|---|
| 2-methyl-butane | 97.35% |
| 1-pentene | 2.17% |
| methyl-terbutylic ether (MTBE) | 47 ppm |
| methyl-teramylic ether (TAME) | 238 ppm |
| teramylic alcohol (TAA) | 4482 ppm |

After a run of 2.3 hours the oxygenated products appear in the outgoing stream in an amount of 200 ppm of TAME, 45 ppm of MTBE and 128 ppm of TAA.
The adsorbing capacity is 10.5%.

Example 7

The material coming from example 2 is subjected to regeneration and reaction cycles. The regeneration is carried out in a tubular reactor feeding inert gas (He: 10 cc/min) raising the temperature to 140° C. in about 1 hour. The effluent gases are analyzed by gaschromatography: the regeneration is considered completed when organic compounds are no longer observed in the effluent.

The adsorption is repeated under the same operating conditions as example 2 with the same charge.

The following table shows the adsorbing capacity of the first seven cycles. It can be seen that the adsorbing capacity remains constant within experimental error.

| Cycle | 1° | 2° | 3° | 4° | 5° | 6° | 7° |
|---|---|---|---|---|---|---|---|
| Adsorb. capacity (%) | 12.5 | 12.6 | 12.4 | 12.3 | 12.6 | 12.5 | 12.5 |

What is claimed is:

1. A process for selectively removing oxygenated contaminants from streams prevalently containing hydrocarbons with from 3 to 8 carbons atoms which comprises adsorbing said oxygenated contaminants by an adsorbent consisting essentially of silica gel having a surface area greater than 300 $m^2/g$ at a temperature of between 0 and 150° C. and a pressure of between 1 and 20 atms, and then removing the adsorbed oxygenated contaminants by thermal treatment in an inert gas stream carried out at a temperature of between 100 and 200° C., with the proviso that the oxygenated contaminant is not water.

2. The process according to claim 1 wherein the silica gel has a surface area greater than 400 $m^2/g$.

3. The process according to claim 1 wherein the silica gel has a porous volume of between 0.38 and 1.75 mg/g.

4. The process according to claim 1 wherein the inert gas is selected from the group consisting of nitrogen, helium, flue gas, air and steam.

* * * * *

UNITED STATES PATENT AND TRADEMARK OFFICE

CERTIFICATE OF CORRECTION

PATENT NO. : 6,111,162

DATED : August 29, 2000

INVENTOR(S): Stefano Rossini et al.

It is certified that an error appears in the above-identified patent and that said Letters Patent is hereby corrected as shown below:

On the title page, item [73], the Assignee's address is incorrect. It should read as follows:

---[73] Assignee: Snamprogetti S.p.A., San Donato Milanese, Italy ---

Signed and Sealed this

Fifteenth Day of May, 2001

*Attest:*

Nicholas P. Godici

NICHOLAS P. GODICI

*Attesting Officer*

*Acting Director of the United States Patent and Trademark Office*